United States Patent [19]

Fisher et al.

[11] Patent Number: 4,817,478

[45] Date of Patent: Apr. 4, 1989

[54] TIMBER MILL

[76] Inventors: Angus C. Fisher, Millbank Road, Terrara, Australia, 254C; William J. Andrews, Emerys Road, West Camberwarra, Australia, 2540

[21] Appl. No.: 105,429

[22] PCT Filed: Nov. 7, 1986

[86] PCT No.: PCT/AU86/00341

§ 371 Date: Sep. 8, 1987

§ 102(e) Date: Sep. 8, 1987

[87] PCT Pub. No.: WO87/02928

PCT Pub. Date: May 21, 1987

[30] Foreign Application Priority Data

Nov. 2, 1985 [AU] Australia ..... PH03333
Sep. 1, 1986 [AU] Australia ..... PH07774

[51] Int. Cl.[4] ..... B26D 1/00

[52] U.S. Cl. ..... 83/35; 83/39; 83/404; 83/407

[58] Field of Search ..... 83/35, 39, 155.1, 106, 83/107, 404, 407, 425.2, 928; 144/376, 378

[56] References Cited

U.S. PATENT DOCUMENTS

| | | | |
|---|---|---|---|
| 3,756,297 | 9/1973 | Heikinheimo | 144/312 |
| 3,856,061 | 12/1974 | Miles | 144/312 |
| 4,009,741 | 3/1977 | Zimmerman | 144/41 |
| 4,086,944 | 5/1978 | Traben | 144/3 P |
| 4,238,983 | 12/1980 | Westmoreland | 83/408 |
| 4,419,914 | 12/1983 | Evans | 83/407 |
| 4,485,705 | 12/1984 | Moilanen | 83/39 |

*Primary Examiner*—William L. Sikes
*Assistant Examiner*—Frank Gonzáez
*Attorney, Agent, or Firm*—Townsend and Townsend

[57] ABSTRACT

A portable timber mill comprising a main superstructure (3) and a platform mounted on the superstructure being comprised of at least one detachable bench (15) on which cutting and sorting operations are performed. Each bench has infeed means (9), cutting means (16) conveyor means (17), sorting and separation means (70, 71) whereby timber can be processed according to a time ordered processing sequence along a predetermined route on the said at least one bench until a predetermined size of timber is achieved. The superstructure is configured in the form of a transportable trailer.

18 Claims, 4 Drawing Sheets

TIMBER MILL

The present invention relates to a lumber processing and saw milling assembly.

Mobile milling apparatuses and the like have hitherto previously been known and used in the past however their size, configuration and arrangement are such that only relatively small amounts of timber could be processed in a given period.

Conventional static plant and equipment such as that found in lumber mill yards and the like are extremely costly to set up and operate, relative to the production rate of sawn timber The said plants are physically bulky consisting of various sawing and handling assemblies, with little sophistication in their integration. Traditionally, only a particular system or technique has been utilized within each individual process as distinct from a number of processes. The problems of the isolation of the various systems and processes from each other is highlighted by the need for transfer chains used throughout traditional mills to link the various processes together. The transfer chains inherently become storage areas requiring constant stoping and starting to overcome poor integration between the various processes. Consequently, cluttering and bunching of timber results, inhibiting a continuous flow and production. Also, once the plant is set up, it cannot be easily relocated either within the particular lumber mill or at an alternative geographic location.

The present invention seeks to ameliorate the prior art disadvantages and to provide a more cost effective and quicker means for milling timber by providing a mobile milling assembly, embracing all of the sawing and handling processes combined which have subsequently been totally integrated to provide a continuous sawing system consisting of detachable, interconnecting benches having an arrangement of conveyors, separators adapted to move laterally and vertically and saws and various apparatuses providing a versatile and variable roundabout facility for secondary, tertiary and subsequent cutting of timber logs after a primary cutting operation has been performed on a particular log.

The saw mill assembly further comprises a timber infeed means connecting with an infeed station, a series of conveyors which move timber from one location to another, at least one set or a series of saw blades at various positions on the assembly for cutting the timber, at least one directing means to control the movement of cut timber around the assembly, at least one return feed means, and means to enable the timber to be exited from the assembly at selected stages of cutting.

The overall assembly is adapted to fit on to or form a trailer suitable for transportation and provides time ordered guiding and separating of cut timber.

According to another aspect of the invention there is a stopper or stoppers provided which work in conjunction with either a gate system or separating means or both combined causing sawn pieces of timber to arrive at a predesignated destination at different time intervals.

The assembly also employs the system of gates and in combination with the stopper to enable the timber to be released from the assembly at intervals or to cause cut timber to remain on the assembly for further cutting.

According to another aspect of the invention there is provided a hob or hobs adapted to be driven, said hob or hobs holding and driving timber through a gauge for cutting by a saw said hob rotating about an axis and adapted to apply a substantially downward force on the timber being cut to avoid riding up of the timber on the hob.

According to a further aspect of the invention there is provided a primary cutting bench in combination with a center bench and a speed bench on which cutting, sorting and conveying functions are performed.

According to another aspect of the present invention there is disclosed method of cutting timber, said method comprising the steps of:

(a) feeding uncut timber through a cutting means at a first location forming at least two sawn pieces;

(b) allowing a first of said sawn pieces to fall under gravity and be subsequently fed through a cutting means at a second location thereby producing at least two cut pieces;

(c) the said pieces of timber produced on the second location being directed and sorted by means of a knife, gate, stopper, rotatable cover and adjoining conveyor system to dictate the separate arrival of the said pieces to other sawing operations, or separate storage locations. The said timbers from the second processes may be redirected, and be reprocessed at the said second location. Preferably a second piece at a different time and a third piece etc. of said sawn pieces (from said first operation) are either pushed across and allowed to fall under gravity to follow said first piece, or are transported to a different location for feeding into a cutting means at another location.

According to another form of the invention there is provided a method of cutting timber according to the abovedescribed method but comprising the additional steps of:

(a) Recutting of timber from a first and second cutting operation bench by a second cutting bench located adjacent to the said first bench but on the opposite side of the first bench to a middle bench, or second sawing operation having a conveyor providing a means of directing timber to different planes.

(b) Recutting of timber on a speed bench by having a cavity to a shute allowing timber to fall onto a conveyer after passing under the conveyor from which it was originally dispatched. The said speed bench being situated adjacent to the second operation first said.

The present invention enables a more time efficient and hence cost efficient means of producing cut timber, as the mill assembly operation enables a system timing regime whereby at least one positive function is performed on each piece of timber being processed whether cut or uncut at any given time by strategically ordered conveying, sorting, positioning rotational conveying and cutting of timber, thereby eliminating waiting time for timber on which a function is to be perfomed, cluttering or bunching of the timber during sawing, and preliminary sorting of logs.

The achieved concurrent performance of the variety of functions results in speedier production of sawn timber and more efficient use of cutting means.

The array of benches and the facility for cutting and recutting by the activation of the continuous feeding conveying, cutting and sorting functions results in the total utilisation of each log, without altering the sawn production rate regardless of log diameter.

The physical size of the assembly is such that the aforesaid improved production rates of each log can be achieved in a much smaller area in comparison to that required for an even lesser output using conventional plant and techniques.

The present invention eliminates the need for a machine known as an unscrambler which machine is connected to the known machines to rectify cluttering and bunching of timber travelling to various benches.

The timber processing regime of the milling assembly provides unscrambling as part of the overall system in that the unscrambling of the timber is carried out by the concurrent sorting conveying and cutting functions.

In its broadest form the apparatus aspect of the invention comprises a compact timber milling apparatus for the continuous sorting, processing and reprocessing of timber into various cross sectional dimensions, said apparatus comprising:

a main superstructure having a primary support means;

a platform formed by or mounted on the superstructure and comprising at least one bench;

a detachable or foldable means for feeding timber onto the said platform;

at least one set of saws associated with each of said at least one bench or benches;

a saw infeed means into each of the said at least one set of saws;

a conveyor or conveyors to direct timber to various locations on said platform on each of said at least one bench or benches;

guide and stopper means to control the passage of timber being processed;

means near said conveyors to enable separation of and re-direction of cut timber across said bench or benches;

a means on the bench or benches to enable exiting of cut timber from said apparatus;

means for transferring timber from one bench to another bench or from one bench to a location off the apparatus;

wherein, when a length of timber is to be processed, a predetermined processing or reprocessing route is selected, said route or routes being created by integration between and the configuration of components on said bench or benches, said components including the conveyors and the said separation means on said bench or benches under control by an operator, thereby enabling time ordered timber processing and reprocessing sequences to be performed on timber until a desired size of timber is achieved.

The embodiments of the present invention will now be described, by way of example only, with reference to the accompanying drawings, in which.

Figure 2:
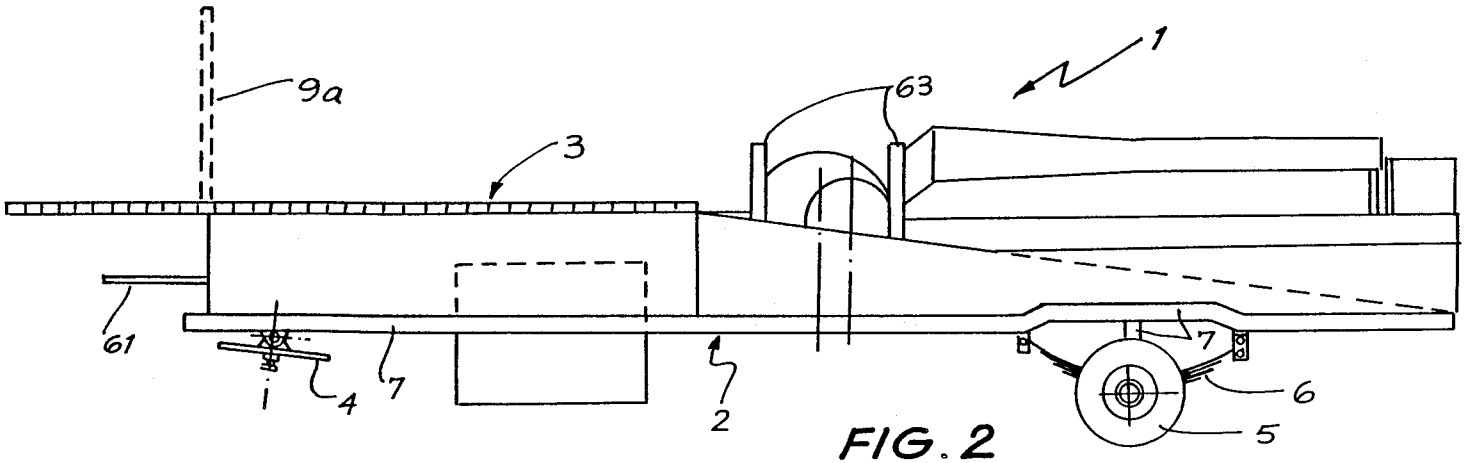
FIG. 2 is a side elevation of the apparatus of FIG. 1.
Figure 3:
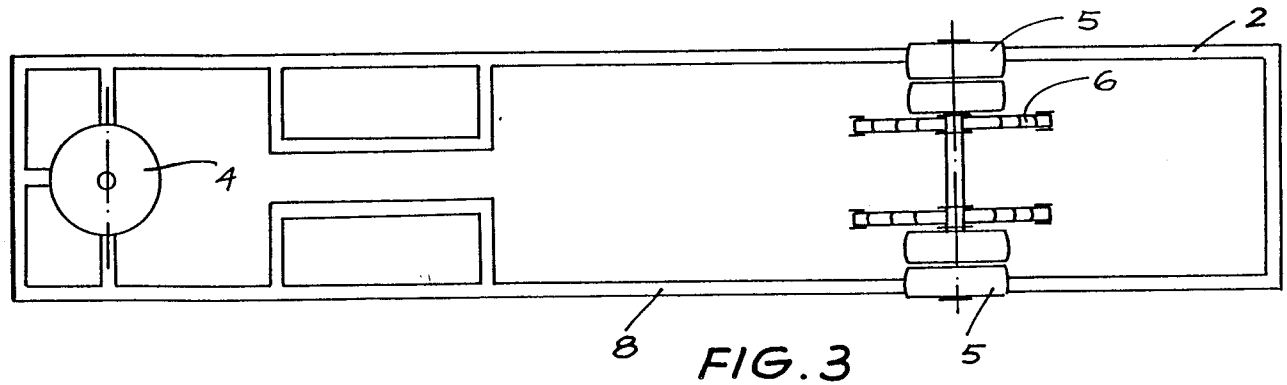
FIG. 3 is a underneath elevation of the apparatus of FIG. 1.

As illustrated in FIG. 2, the portable saw milling trailer 1 comprises an infrastructure 2 and a super structure 3. The infrastructure 2 comprises conventional trailer components such as the towing turntable 4, spring mounted towing wheels 5 including leaf spring 6. Each of the components 4, 5 and 6 being mounted on a trailer frame 7. The frame 7 which bears the super structure 3 can be constructed and fabricated in any manner suitable to such regulating authorities as Departments of Motor Transport and other bodies.

Figure 1:
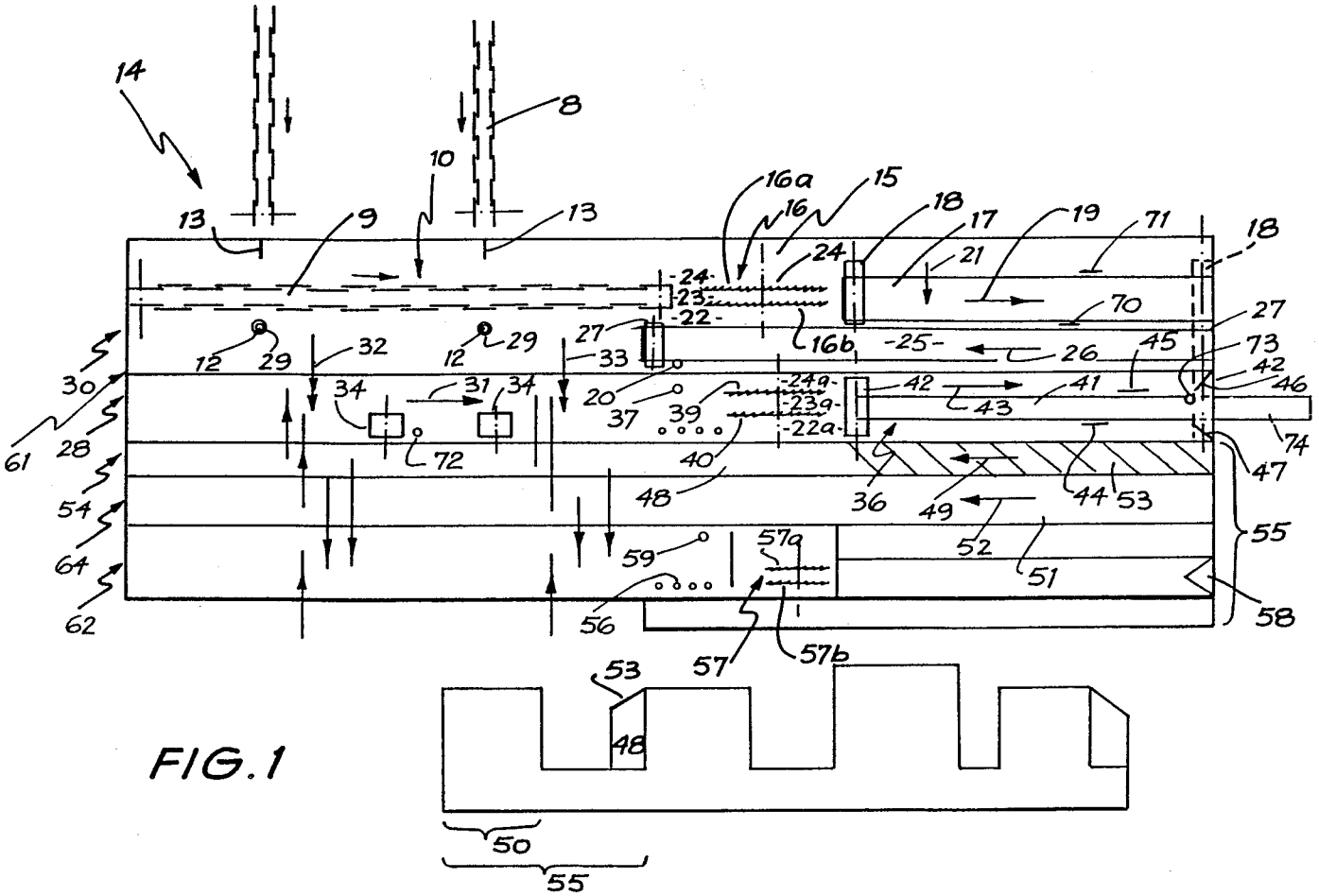
FIG. 1 is a plan view of the trailer arrangement of a portable saw mill.

As illustrated in FIG. 1 the super structure 3 includes transverse infeed chains 8 which move logs from ground level onto the longitudinal infeed chain 9. The infeed chain 9 has at intervals thereon a series of log holders 10. The movement of a log from infeed 8 to longitudinal 9 is by way of log tipping from infeed 8 on to log kickers 13 which lift and provide lateral movement towards chain 9 and allow the log to be placed and roughly aligned in relation to saw blades. For log alignment, kickers 13 are used in conjunction with stoppers 12 which travel up on a vertical axis. The kickers 13 then apply pressure required for log to make contact with both stoppers 12. Hence the log is aligned. Stoppers 12 and kickers 13 have rollers 29 incorporated which allow for the passage and alignment of a log while moving forward towards saw blades 16. These rollers 29 may be self powered to inhibit fouling of the log. The log is fed from the input station, generally designated 14 and comprising the components of items 8 through to 13 inclusive, into the first saw milling station generally designated 15. The saw milling station 15 includes two large saw blades 16*a* and 16*b* which are movable laterally. These blades 16*a* and 16*b* are in line with the longitudinal feed chain 9 and enable two cuts to be made in the log on the first pass. Riving knives held taut between support 63 (see FIG. 2) and bench, support the log. Directly after the saw blades 16*a* and 16*b* is a conveyor belt 17 which rotates about the rollers 18. The conveyor 17 moves the now sawn log in the direction of arrow 19. It is important to note that the saw blades 16*a* and 16*b* will produce three longitudinal pieces of timber, the first at location 22, the second at location 23 and the third at location 24. The piece of timber at location 22 will fall without any pushing or prodding directly onto conveyor 25 to be carried in the direction of arrow 26. Once the piece of timber at location 23 passes the saw blades 16*a* and 16*b* supported by knife 70 (which is laterally adjusted with blade 16*b*) which moves in the direction of arrow 21 and vertically to push timber 23 to conveyor 25. While knife 70 is held in its highest vertical position log sweeper 71 is moved in direction of arrow 21 to push piece of timber 24 onto conveyor 25. The conveyor 25 rotates about rollers 27 and once the timber 22, 23, 24 has cleared the last roller 27 it is in the second saw milling staging area 28. The above operation is controlled by a breaking down saw operator as best facilitates optimum delivery of timber to staging area 28.

The staging area 28 has cross feed chains 32 and 33 as well as rollers 34. The cross feed chains 32 and 33 and rollers 34 and gauge 72 are translatable by approximately 4 to 8 feet in the direction of arrow 31 and back again to the position as illustrated in FIG. 1. These cross chains 33 and rollers 34 are there to enable longer planks and timber to be fed through the second saw milling station 36 in direction of arrow 31 also known as the center bench. The logs from the staging area 30 are fed across by the cross chains 32 and 33 moving up vertically to contact timber and move it laterally until it contacts sizing gauges 37 and 72 which can move simultaneously and parallel to saw blades 39 and 40, thus providing alignment of rough edged timber. Cross chains are lowered, gauges 37 and 72 are moved clear, leaving timber aligned on rollers. Timber is then moved either manually or driven by rollers 34 through saws 39 and 40. The saw blade 40 is moveable and repositionable to enable different widths of planks and timber to be cut.

The hob 20 helps provide drive and alignment due to pressure applied and moves timber into blades 39 and 40.

The hob 20 rotates about an axis which is at an angle to the vertical and exerts a downward force on the timber being cut. The downward force is produced simultaneously as a forward driving force which is also produced by the hob. This downward driving force can be produced simultaneously by a hob rotating about a vertical axis and the outer surface of the hob, rotating about an axis perpendicular to the vertical.

The hob 20 is retractable and is stored adjacent roller 27 on conveyor 25, within the space formed by the belt of conveyor 25. The hob can be either automatically tripped to bring same into operation, or it can be manually activated by the operator. The hob 59 on the speed bench 50 can operate in the same fashion.

Similar to the break down bench 15, the center bench 36 produces three further pieces of timber, here designated 22A, 23A and 24A. While being cut by the blades 39 and 40 timber 22A, 23A and 24A inherently move onto the conveyor 41 which is mounted upon rollers 42. The conveyor 41 moves the timber in the direction of arrow 43 towards the rear of the trailer 1. The timber 22A, 23A and 24A are then controlled in their movements by means of the separators 44 and 45 (see FIG. 2) as well as the gates 46 and 47. The separators 44 and 45 are moveable in the vertical direction while the gates 46 and 47 revolve around a vertical axis to direct timber either onto a third milling station, also known as a speed bench 50, or onto conveyor 25 to staging area 28 and thence to bench 36, or off the trailer for sizing or stacking purposes, or, if it happens to be rubbish, also off the trailer.

The separator 45 and gate 46 are laterally moveable to keep in register with the moveable blade 40. Between separators and in front of gates is a stopper which can move vertically up or down. This feature allows timber to be stopped. In the up position, for example, with both gates open, the lines would allow both waste timbers to carry on out to rear of mill; because the stopper is situated in front of gates it is then possible to lift either the left or right separator, close the relevant gate then lower the stopper. Timber then moves to destination required at a different time to previous timbers, thus sorting is achieved. While timber is held by stopper conveyor moves underneath. The gate 47 can serve to act upon either the timber 22A or 23A while the gate 46 can operate on timber 23A and 24A. Timber 22A and 23A can be, by means of the gate 47 and stopper 73, directed onto the conveyor 48 which moves in the direction of arrow 49 or onto the next adjacent conveyor 51 which moves in the direction of arrow 52 and which allows timber 22A and 23A to arrive at the same stages 64 or 54 at different intervals. Timbers 22A and 23A are directed by separators, gates and stoppers in conjunction with the rotatable cover and two adjoining return conveyors. These are used to impose a time sequence to separate and sort timbers 22A and 23A onto separate conveyors 51 and 48 at different intervals. The following steps describe the above. Stopper 73 is in the up position situated to retain timber 23A and allow 22A to carry on for further direction. Consequently, the separators can be in vertically up or down position, allowing gate 47 to be closed against separator 45 behind stopper 73, thereby directing, for example, timber 22A over cover 53 onto conveyor 51 with rotatable cover 48 in the down position. Rotatable cover 48 changes position before stopper 73 is lowered. Timber 23A is delivered onto conveyor 48 passing under knife 44 after stopper 73 is lowered. Separators 44 and 45 are best utilized in the down position in the case of timber 23A being finished and enabled to carry on over retracted stopper 73 to rear of mill, with timber 22A being directed onto return conveyors 51 and 48 by gate 47 on separator 44 simultaneously. As previously described, all timbers from bench 36 to stage area 54 and 64 either arrive individually at different intervals on each individual stage or arrive individually at different intervals on separate stages. The said individual timbers are transferred by cross chains strategically arranged to deliver timber according to selected time intervals and according to the sorting system required from bench 36. The said timbers may be delivered to bench 36 or speed bench 50 from both stages being 54 and 64. Timbers from stage areas 30, 54 and 64 often at saws 40 and 39 in combination with hob 20 and gauge 37 can produce two sizes of finished sawn timbers simultaneously. This is achieved by said timber moving manually or driven by rollers 34 until adjacent to hob 20 which moves laterally towards the gauge until contacting the timber.

The conveyor 51 and speed bench 50 are on a moveable (detachable) platform generally designated 55 which is adapted to fold over into the trailer body 1.

The speed bench 50 comprises a gauge 56 and the two saws blades **57*a* and 57*b* which are adjustable similarly to saws 39 and 40. These saws are usually of a size smaller than the saws 16, 39 or 40. The timbers being cut by the saws 57*a* and 57*b* are directed towards the kick-off directors 58 which can either re-direct the material onto the conveyor 51 or off the rear of the trailer 1** for docking and stacking or off the side of the trailer for docking and stacking and/or rubbish tipping.

In association with the gauge 56 there is also a hob 59 also rotating to drive the timber through the saw 57.

The trailer 1 if necessary, can be operated by a single operator however, for maximum efficiency three operators are desired. The operators stand upon the folding platform 61 which holds two persons while a third person would be located in area 62 for operation of the speed bench 50. If a single man operation is required then the trailer 1 and machinery thereon would require more automation however the configuration and set up of the apparatus on the trailer 1 is such that automation is easily adapted.

Figure 6:
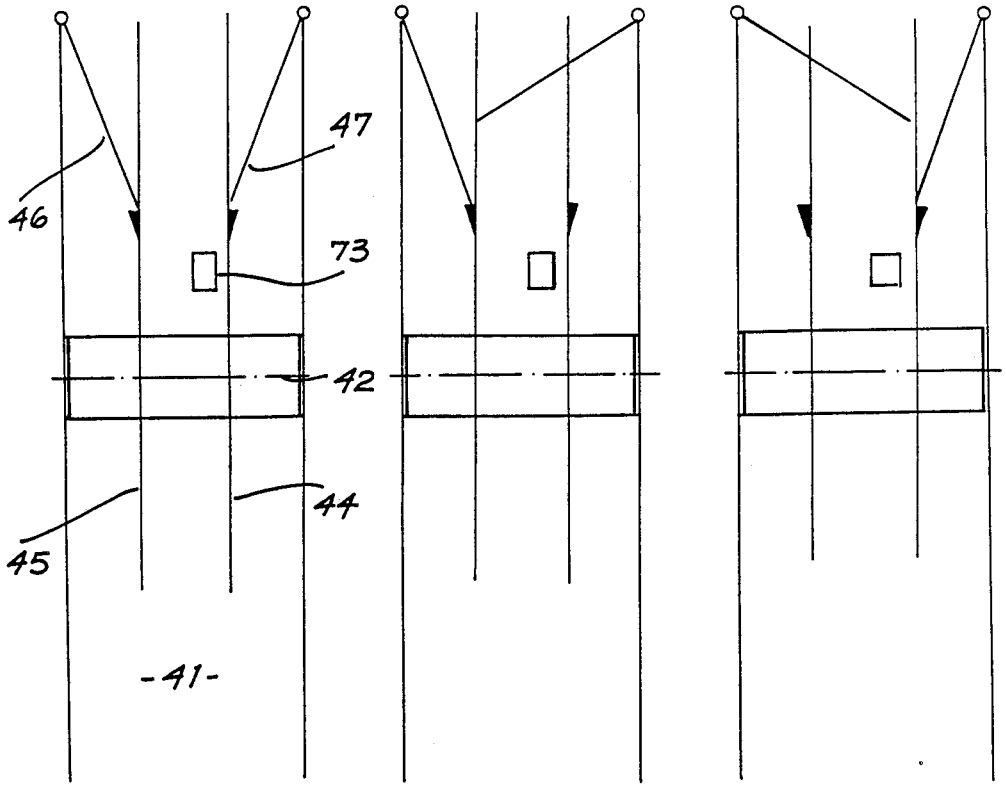
FIG. 6 is a schematic representation of separator and gate operation at rear of conveyor 41.
Figure 4:
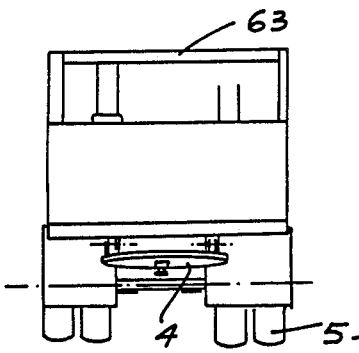
FIG. 4 is a front elevation of the apparatus of FIG. 1.
Figure 5:
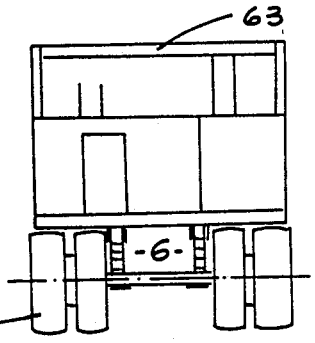
FIG. 5 is a rear elevation of the apparatus of FIG. 1.

The speed bench 50 can utilise a very fine bladed saw 57. The arrangement as illustrated in FIG. 1 of the breakdown bench 15, centre bench 36 and high speed bench 50 can be re-oriented as schematically illustrated in FIG. 6 for the purposes of transportation. The system of FIG. 1 keeps in permanent location the breakdown bench 15 and center bench 36 while the speed bench 50 can rotate over into the body of the trailer 1. Of course, the transverse infeed chains 8 can be rotated into the body of the trailer 1 for transportation purposes as can extension 74. It is envisaged that logs up to a size of approximately two to three feet in diameter can be handled by the apparatus.

Figure 7:
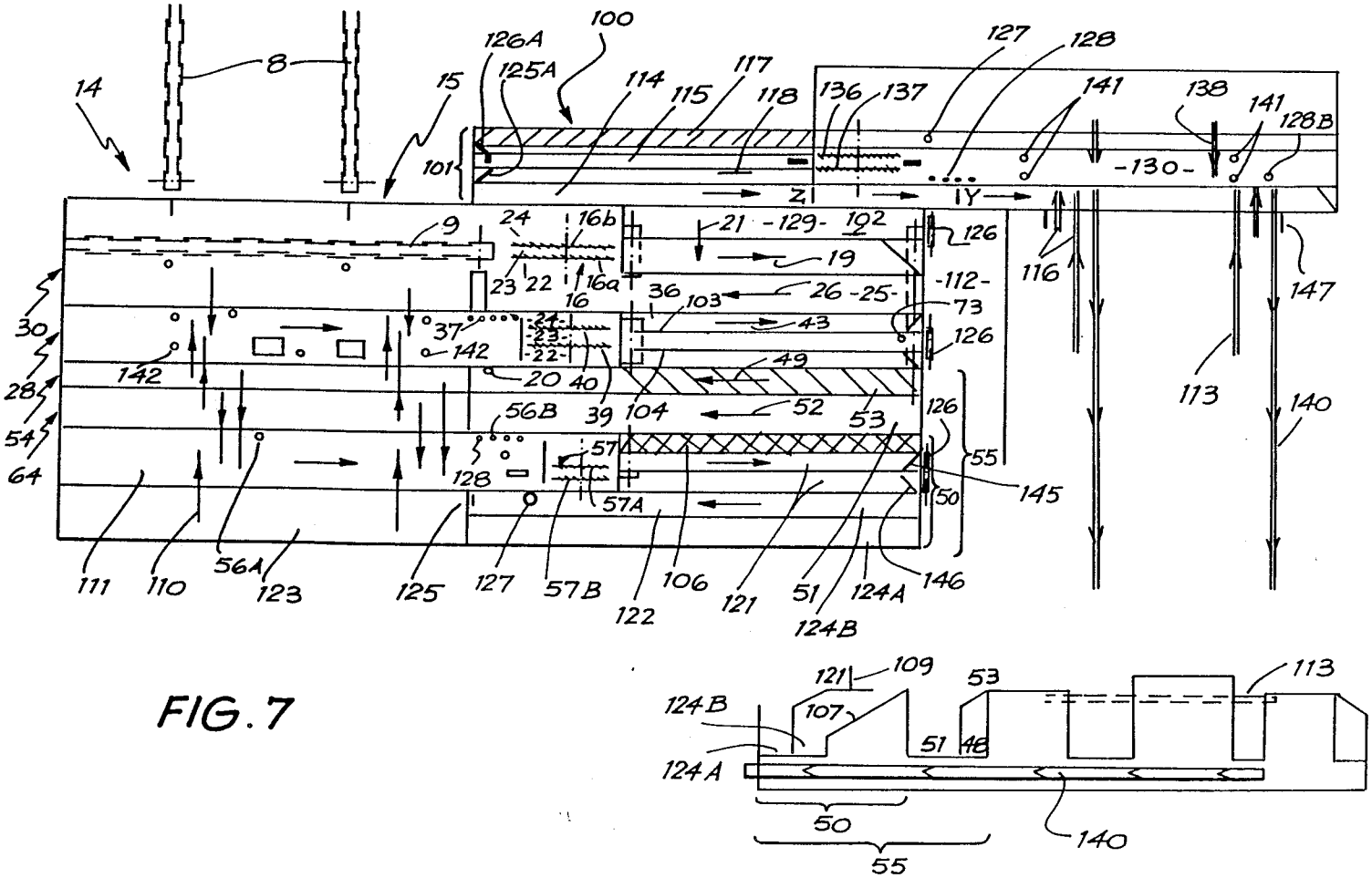
FIG. 7 represents a plan view of a further embodiment of the portable saw mill assembly.

FIG. 7 shows a plan view of an alternative embodiment of the milling assembly. The assembly shown in FIG. 7 is a modification of the embodiment as described in FIG. 1 wherein additional benches have been detachably fixed to the assembly.

The embodiment 100 of FIG. 7 is substantially identical to that of FIG. 1 in terms of apparatus used except for the additional cutting bench 101 which is added at a position adjacent to the first cutting bench 15 of FIG. 1. Whereas in FIG. 1 the cutting bench 15 had two planar separators 70 and 71 bench 15 in the embodiment shown in FIG. 8 has a single separator 102 situated behind saw 16B for sorting and directing of the timber which is cut by the blades 16*a* and 16*b*.

Another difference between the embodiment 100 and that of the mill assembly depicted in FIG. 1 is the reversal between the positions of hob 20 and sizing gauge 37 relative to blades 39 and 40. Furthermore the blade 40 is a fixed blade in the apparatus of FIG. 8 whereas it was a moveable blade along with blade 39 in the embodiment of FIG. 1.

Blade 39 in the assembly of FIG. 8 is a moveable blade whereas blade 39 in FIG. 1 was a stationary blade.

A similar change has occurred to the separators 103 and 104 in that the separator 103 of FIG. 8 is now a fixed separator and the separator 104 is moveable. In FIG. 1 these separators were designated as 44 and 45 with separator 44 being a fixed separator and separator 45 being moveable.

In FIG. 1 the moveable (detachable) bench 55 comprised a conveyor 51 and a speed bench 50. In the embodiment of FIG. 8 the cover 53 and the conveyor 51 are both retained. The hob 59 and the sizing guage 56 have been retained but their positions have been reversed relative to the saw blade 57.

The speed bench 50 has been considerably modified in FIG. 8 by comparison to its appearance in FIG. 1. The new configuration of the speed bench 50 comprises a cavity portion 106 which leads to a shute portion 107 which allows timber to pass under conveyor 121 and be delivered onto return conveyor 124B while other timber is being directed over covered conveyor 121 onto conveyor 124A simultaneously or otherwise. Conveyor 124B is covered and allows timber to be carried forward until the timber encounters a stop 125 which can be activated or deactivated according to system requirements. In this respect, a piece of timber can be held back on conveyor 124B until a piece of timber on conveyor 124A has travelled onto stage area 111. Timber on conveyor 124B can access bench 123 via jump up region 122 after the stopper 125.

Timber passing from conveyors 124A or 124B locates on cross feed chains 110 to move timber onto preparation bench 111. Timber on bench 111 can then be fed into saw 57A and 57B combined for recutting and resorting on speed bench 50.

Other modifications to bench 30 FIG. 8, are that separator 109 is laterally more able to locate behind saw 57B. Separator 109 is physically stepped to allow it to move from saw to saw while a stopper is in up position. Also, a retractable stopper is incorporated in front of gates 145 and 146. The stopper initiates the sorting and separation of timber (as previously described on bench 36) from saws 57A and 57B, to service conveyors 124B via cavity 106, shute 107 and 124A via conveyor 121.

Another change in FIG. 8 is the employment of timber aligners. The said aligners are incorporated in benches 36 and 101 as they receive timber with uneven edges being unsuitable for guage and hob utilization for alignment. The aligners are situated in front of the saws. In practice, they push laterally on the outside edges of a said timber towards each other at each end of the timber in question. Another aspect of FIG. 8 is that all securing stations have power press down assisting wheels situated immediately in front and behind of saw blades. The said wheels move vertically down and apply pressure on top of timber passing through the saws. A suitable drive means provided to the said press down wheels also provides extra assistance to saw infeed systems.

Another change in FIG. 8 is a powered roller situated at the end of infeed chain 9 and in front of saws 16A and 16B. In practice the powered roller moves up and clears the log from the infeed chains immediately before its departure. Consquently it stops the moving infeed chain's log support from catching on the end of a log when changing direction around the driving means sprocket.

The embodiment of FIG. 8 also differs from that of FIG. 1 in that another motor area 112 is provided for driving of the cutting bench 101. Cutting bench 101 includes cross chains 113 conveyors 114, conveyor 115 and 117, a knife 118 similar to the knife system on speed bench 50 on the side the mill. Gates 125 and 126 are also provided. The bench 101 also includes a hob 127 and a gauge 128. Bench 100 is utilised as follows.

A sawn log after passing through the chain conveyor 9 and through the first blade 16 or bench 15 will end up as three pieces. A single piece will end up on conveyor side 129 and this can proceed towards motor region 112 via exit roller 126. The remainder of the timber cut at this time on bench 15 is processed in the manner previously described. After reaching powered roller 126 the said timber substantially increases forward speed, then being delivered across to transfer chains 116 which deliver timber to alignment area 130 the transfer of timber to 130 by chains 116 is uninhibited by the other timber due to the increase in speed by roller 126 from conveyor 120 which creates a time gap from the following timber. Timber is then aligned with aligners number 141 and passed through non movable saw blade 136 and movable saw 137. The fate of the various sawn timbers are determined by the sorting systems previously described as employed on benches 36 and 50. The difference being that all finished sawn timber on bench 101 exits bench 101 on conveyor 114 and is directed onto green chains 140 by closed gate. Any waste on conveyor 114 carries on through an open gate to a different location. The majority of waste is dispatched over cover 117 directed by gate 126. Conveyor 114 has the ability to pivot around on an axis at point Z allowing point Y to move up vertically and deliver timber onto cross chains 116 ready for sawing. Conveyor 114 constitutes a separate section.

It is envisaged that timber for bench 101 from conveyor 129 before reaching exit roller 126, be pushed sideways onto a conveyor to be situated between 129 and 114. The said extra conveyor would deliver timber to transfer chains 116 without interfering with the timing sorting schedule of bench 101.

Referring now to speed bench 50 the bench can be utilised as follows. Timber from preparation bench 111 passes through saw blade 57. A separator 109 and gate direct one piece of timber into opening 106 so that it falls by gravity onto inner conveyor 124B. Alternatively, that piece of timber can be allowed to exit the machine via exit roller 126. Another piece of timber on the side of the knife separator opposite to the opening 106 falls to the side of the cover 139 and onto conveyor 124A. Both of the pieces of timber described can be recut passing via bench 123 and bench 111 with one piece of timber on inner conveyor 124B being delayed as previously described when the situation demands.

It will be recognised by persons skilled in the art that numerous variations and modifications can be made to the present invention such as but not limited to the deletion or addition of various benches, without departing from the overall spirit and scope of the invention as broadly described herein.

We claim:

1. A compact timber milling apparatus for the continuous sorting, processing and reprocessing of timber into various cross sectional dimensions, said apparatus comprising:

a main superstructure having a primary support means;

the superstructure including a platform superstructure and comprising at least one bench;

the superstructure including means for feeding timber onto the said platform;

at least one set of saws associated with each of said at least one bench;

a saw infeed means into each of the said at least one set of saws;

a conveyor means to direct timber to various locations on said platform on each of said at least one bench;

guide and stopper means to control the passage of timber being processed;

means near said conveyor means to enable separation of and re-direction of cut timber across said at least one bench;

a means on the said at least one bench to enable exiting of cut timber from said apparatus;

means for transferring timber from one bench to another bench or from one bench to a location off the apparatus;

wherein, when a length of timber is to be processed, a predetermined processing or reprocessing route is selected, said route being created by integration between a configuration of components on said at least one bench, said components including the conveyor means and the said separation means on said at least one bench under control by an operator, thereby enabling time ordered timber processing and reprocessing sequences to be performed on timber until a desired size of timber is achieved.

2. A milling apparatus according to claim 1, characterised in that the said main superstructure comprises a wheel supported trailer adapted for transportability.

3. A milling apparatus according to claim 2, having a means on the superstructure enabling the detachable attachment of an additional at least one bench along a peripheral edge of the superstructure.

4. A milling apparatus according to claim 3, wherein the said platform is comprised of three cutting benches each having a pair of spaced apart saw blades comprising the said set of saws.

5. A milling apparatus according to claim 4, wherein each of the said at least one bench has at least two conveyor belts, first conveyor to receive timber immediately after cutting, another conveyor to receive cut timber from said first conveyor and to redirect cut timber to an alternative location on said platform.

6. A milling apparatus according to claim 5, wherein the said means for separation of the cut timber comprises at least one moveable rod substantially in alignment with the said conveyor means and adapted to move laterally relative to the direction of motion of said conveyor means.

7. A milling apparatus according to claim 6, wherein the timber separation means comprises two elongated flat bars which are disposed parallel to said conveyor means and which are adapted to move substantially vertically and laterally relative to the said conveyors means.

8. A milling apparatus according to claim 7, wherein the said timber separation means are operable from a position forward of rearward of each bench.

9. A milling apparatus according to claim 8, wherein at least one of said three benches has one conveyor to receive cut timber from a conveyor of an adjacent bench, a pair of parallel conveyors which are adapted to receive cut timber which is urged to fall by separation means from either side of an overhead conveyor also located on said bench, at least one infeed means for transfering timber from an adjacent location and a saw infeed means.

10. A milling apparatus according to claim 9, wherein at least one other bench comprises a saw infeed means to infeed timber into a pair of saw blades, means to enable exiting of cut timber from the bench, conveyor means to transfer timber to a location adjacent to said bench.

11. A milling apparatus comprising a first cutting bench, in combination with a second and third bench, said first bench comprising:

a saw infeed means, a cutting means for cutting timber from said saw infeed means, a first conveyor for receiving cut timber from the cutting means, a means for allowing exiting of cut timber from said first bench, a second conveyor for transferring cut timber from said first conveyor to another location means for separating cut timber and directing said cut timber along a preselected route according to a preselected time sequence;

said second bench being adjacent said first bench and comprising:

a infeed means for receiving timber from said first bench;

a second cutting means for cutting timber from said saw infeed means;

a first conveyor for receiving cut timber from said cutting means;

a means for allowing exiting of cut timber from said second bench;

said third bench adjacent said second bench and comprising:

at least one conveyor to receive cut timber from the conveyor of an adjacent bench;

a means for transferring timber from said conveyor to a saw infeed means on said third bench;

a cutting means to receive timber from said saw infeed means;

a pair of parallel conveyors which are adapted to receive cut timber which is urged to fall by separation means located on said third bench, from either side of an overhead conveyor also located on said third bench;

a means for enabling exiting of cut timber from said overhead conveyor;

a means for transferring timber from either of said pair of conveyors to said saw infeed means; wherein when a piece of timber is to be processed, the said timber is initially cut on said first bench then guided along a predetermined route for exiting said first bench or reprocessing on said second or third benches.

12. A milling apparatus according to claim 11, wherein an additional bench is connected to said first bench to receive timber which has exited either of said first, second and third benches for reprocessing;

said additional bench comprising at least one adjustable bench infeed means;

a cutting means to receive timber from a saw infeed means;

a separation means for directing timber after being cut by said cutting means along a selected route;

a conveyor means for transferring cut timber to another location on said additional bench for reprocessing or off said additional bench;

a means for enabling the exiting of cut or uncut timber from said additional bench.

13. A milling apparatus according to claim 12, wherein each of the said saw infeed means comprise an array of rollers;

the said separation means comprise at least one elongated plate adapted to move laterally and vertically relative to the conveyor means;

said cutting means comprising a pair of spaced apart rotating saw blades.

14. A milling apparatus according to claim 13, wherein said rollers are in alignment with the said saw blades and the said conveyors are substantially parallel to the direction of feed of timber into said cutting means.

15. A milling apparatus according to claim 14, wherein at least one conveyor on at least two benches is sloped downwardly away from said cutting means on said at least two benches.

16. A milling apparatus according to claim 15, wherein the said third bench is adapted for folding towards the said second bench.

17. A method for cutting timber using a milling apparatus comprising the steps of:

(a) feeding uncut timber through a cutting means at a first location to form at least two cut pieces;

(b) allowing a first of said cut pieces to be urged to fall under gravity and to be subsequently fed through a cutting means at a second location thereby producing at least two further cut pieces;

(c) alternatively allowing at least one piece of cut timber from said first location to exit said first location;

(d) manually directing and sorting according to a time ordered sequence the said pieces of timber produced on the second location with the assistance of a separator, gate, stopper, rotatable cover and adjoining conveyor system to dictate the separate arrival of the said pieces to other sawing operations on separate locations;

(e) optionally redirecting said cut timber from said second location for reprocessing on said second location via a third location;

(f) allowing timber from said second location to be transported to a third location for processing through a third cutting means to provide at least two pieces of cut timber;

(g) optionally allowing timber from said third location to exit from said third location and optionally allowing timber from said third location to be redirected for reprocessing on said third location.

18. A method according to claim 17, comprising the additional steps of:

(a) allowing timber which exits said first, second or third location to be transferred to a fourth location, optionally allowing timber from another location other than said first, second or third location to be transferred to said fourth location;

(b) allowing said timber on said fourth location to be processed through a cutting means on said fourth location;

(c) optionally allowing timber from said fourth location to be reprocessed on said fourth location;

(d) allowing timber to exit said fourth location; and (e) collecting said timber.

* * * * *

UNITED STATES PATENT AND TRADEMARK OFFICE

CERTIFICATE OF CORRECTION

PATENT NO. : 4,817,478

DATED : Apr. 4, 1989

INVENTOR(S) : Angus C. Fisher and William J. Andrews

It is certified that error appears in the above-identified patent and that said Letters Patent is hereby corrected as shown below:

Title page:

Under "Foreign Application Priority Data", delete "Nov. 2, 1985" and substitute --Nov. 7, 1985--.

Signed and Sealed this

Thirtieth Day of April, 1991

*Attest:*

*Attesting Officer*

HARRY F. MANBECK, JR.

*Commissioner of Patents and Trademarks*